US005306568A

United States Patent [19]

Matsuda et al.

[11] Patent Number: 5,306,568

[45] Date of Patent: Apr. 26, 1994

[54] HIGH YOUNG'S MODULUS MATERIALS AND SURFACE-COATED TOOL MEMBERS USING THE SAME

[75] Inventors: Yukinori Matsuda, Nagoya; Kozo Ozaki, Tohkai; Koichi Sudo, Nagoya, all of Japan

[73] Assignee: Daido Tokushuko Kabushiki Kaisha, Nagoya, Japan

[21] Appl. No.: 873,167

[22] Filed: Apr. 24, 1992

[30] Foreign Application Priority Data

Apr. 26, 1991 [JP] Japan ..... 3-097426
Jun. 5, 1991 [JP] Japan ..... 3-161143

[51] Int. Cl.[5] ..... B32D 15/00; C22C 38/36

[52] U.S. Cl. ..... 428/548; 428/660; 75/246; 75/230; 75/232; 75/236; 75/239; 75/240; 420/10; 420/15

[58] Field of Search ..... 420/10, 15, 101, 110, 420/111, 114; 75/246, 230, 232, 236, 239, 240; 428/548, 660; 148/328

[56] References Cited

U.S. PATENT DOCUMENTS 4,704,169 11/1987 Kimura et al. ..... 420/580

FOREIGN PATENT DOCUMENTS 54-4202 1/1979 Japan ..... 420/10
56-139619 10/1981 Japan ..... 148/651
58-185751 10/1983 Japan ..... 420/10
61-159552 7/1986 Japan .

*Primary Examiner*—Deborah Yee
*Attorney, Agent, or Firm*—Sughrue, Mion, Zinn, Macpeak & Seas

[57] ABSTRACT

A high Young's modulus material comprises carbon steel or alloying steel and contains a particular amount of hard particles having a Young's modulus of not less than 24,000 kgf/mm$^2$. Furthermore, a surface-coated tool member comprises a substrate comprised of carbon steel or alloying steel and a hard coating layer having a Young's modulus of not less than 24,000 kgf/mm$^2$ in which the substrate contains a particular amount of hard particles having a Young's modulus of not less than 24,000 kgf/mm$^2$.

13 Claims, No Drawings

HIGH YOUNG'S MODULUS MATERIALS AND SURFACE-COATED TOOL MEMBERS USING THE SAME

BACKGROUND OF THE INVENTION

1. Field of the Invention

This invention relates to high Young's modulus materials having high hardness and toughness and excellent wear resistance and capable of working in a high accuracy which are suitable as a material for cold working tools used under severer conditions as well as machine structural members requiring high regidity. And also, the invention relates to surface-coated tool members provided with a hard coating layer having a Young's modulus of not less than 24,000 kgf/mm$^2$.

2. Description of the Related Art

Heretofore, super-hard materials (or cemented carbides) having a high Young's modulus have been used in cold working tools requiring a high accuracy such as punch for fine blanking, dies and the like.

On the other hand, high-alloying and high speed tool steels have been used in cold working tool made from molten steel material.

As a machine structural member requiring a high rigidity, there were used steel materials for machine structure by subjecting them to a heat treatment such as quenching, tempering or the like or a surface improving treatment such as carburizing, carbo-nitriding, nitriding or the like.

In punch, dies and the like for cold punching or cold forging, a coating layer of TiN, TiC or the like is formed on the surface of the substrate by a process such as PVD, CVD or the like for improving the service life.

For, example, when a hard coating layer such as TiN is formed on the surface of the substrate, the seizure or baking is prevented because TiN is less in the affinity with the steel material and is hard. And also, the working can smoothly be conducted because TiN is excellent in the abrasion resistance and the service life of the tool can be prolonged.

However, when a super-hard material is used in the cold working tool, the toughness is poor as compared with that of an iron series tool material, and also the cutting is not conducted in the working into a tool and the grinding becomes difficult.

In the high-alloying high-speed tool steel, the Young's modulus is 25000 kgf /mm$^2$ at most. Therefore, if the alloying is further increased, macro-carbide crystal precipitates to lower the toughness and also the hot workability and the cutting and grinding in the working into tool degrade.

In the machine structural steel, the Young's modulus is 21,000 kgf/mm2 at most. Particularly, when the substrate requires high rigidity, the above steel is lacking in the Young's modulus, so that the thickness of the substrate is increased for compensating the Young's modulus and consequently the weight reduction of the tool member can not be attained.

When the working such as punching or the like is conducted with a tool having a coating layer in its surface, the substrate of the tool is deformed in the working, whereby the coating layer is subjected to strains. As a result, the coating layer is peeled off from the surface of the substrate or cracks are produced in the coating layer to finally bring about the breakage of the substrate.

Therefore, it is desired to develop high Young's modulus materials capable of reducing or solving the above problems as well as tool members provided therewith.

SUMMARY OF THE INVENTION

It is an object of the invention to solve the above problems of the conventional techniques and to provide high Young's modulus materials which are high in the Young's modulus as compared with the general iron steel materials and excellent in the toughness as compared with the super hard materials, and can apply the cutting and grinding in the working into tools and reduce the thickness or the like to attain the weight reduction when the Young's modulus is larger than that of the machine structural steel and the rigidity is approximately equal thereto.

It is another object of the invention to provide surface-coated tools capable of preventing the occurrence of cracking in the coating layer and the peeling of the coating layer from the substrate.

According to the invention, there is the provision of a high Young's modulus material comprising a carbon steel or alloying steel and containing 5–70% by volume of hard particles having a Young's modulus of not less than 24,000 kgf/mm$^2$ therein.

In a preferred embodiment of the invention, the carbon steel or alloying steel is a molten material and is shaped together with 5–70% by volume of hard particles having a Young's modulus of not less than 24,000 kgf/mm$^2$ by molding or melt forging. That is, at least a part of the resulting material is a portion having high Young's modulus and toughness and capable of being subjected to cutting and grinding.

In another preferred embodiment of the invention, the carbon steel or alloying steel is powder and is shaped together with hard particles having a Young's modulus of not less than 24,000 kgf/mm$^2$ by powder metallurgical manner and then sintered. That is, at least a part of the resulting material is a portion containing 5–70% by volume of the hard particles and having high Young's modulus and toughness and capable of being subjected to cutting and grinding.

In the other preferred embodiment of the invention, only powder of carbon steel or alloying steel containing hard particles having a Young's modulus of not less than 24,000 kgf/mm$^2$ is shaped by powder metallurgical manner and the sintered, or the above powder is dispersed into a molten bath of carbon steel or alloying steel and then solidified by molding or melt forging. Thus, the resulting material contains 5–70% by volume of hard particles having a Young's modulus of not less than 24,000 kgf/mm$^2$ in carbon steel or alloying steel.

In a more preferable embodiment of the invention, the material has a specific elasticity of not less than $28\times10$ 8 mm represented by Young's modulus/density, whereby the weight of the working tools, particularly machine structural member can be more reduced.

DESCRIPTION OF THE PREFERRED EMBODIMENTS

In the high Young's modulus material according to the invention, carbon steels for machine structure (e.g. JIS S-C material, S-CK material and the like), nickel-chromium steels (e.g. JIS SNC material and the like), nickel-chromium-molybdenum steels (e.g. JIS SNCM material and the like), chromium steels (e.g. JIS SCr material and the like), chromium-molybdenum steels (e.g. JIS SCM material and the like), manganese steels (e.g. JIS SMn material and the like), manganese-chromium steels (e.g. JIS SMNC material and the like), carbon steels for tool (e.g. JIS SK material and the like), steels for high-speed tool (e.g. JIS SKH material and the like), alloying steels for tool (e.g. JIS SKS, SKD, SKT materials and the like), high carbon chromium bearing steels (e.g. JIS SUJ material and the like) may be used as the carbon steel or alloying steel. Furthermore, the above chemical composition defined according to JIS may be added with adequate amounts of the other alloying components, or may be properly changed.

As mentioned above, the carbon steel or alloying steel capable of being subjected to a heat treatement is used in the high Young's modulus material according to the invention, so that the strength, toughness, hardness and the like can properly be changed by the heat treatment. In this case, if it is required to conduct the grinding for the high Young's modulus material, the matrix may be softened by subjecting to an annealing, while if it is required to enhance the strength and toughness, the matrix may be strengthened by subjecting to quenching and tempering.

As the hard particle having a Young's modulus of not less than 24,000 kgf/mm$^2$ to be included in the carbon steel or alloying steel, use may be made of carbides and nitrides of Periodic Table Group 4A elements (Ti, Zr, Hf), carbides and nitrides of Group 5A elements (V, Nb, Ta), carbides and nitrides of Group 6A (Cr, Mo, W) and the like as well as borides, silicides, sulfides, oxides and the like of these elements. In this case, one or more of these compounds may properly be selected and used.

These hard particles are dispersed into a melt of the carbon steel or alloying steel, or are shaped with powder of the carbon steel or alloying steel, or a melt or powder of the carbon steel or alloying steel containing the hard particles dispersed therein is shaped by powder metallurgical manner and sintered, or the hard particles are dispersed into a melt of the carbon steel or alloying steel by molding or melt forging manner, whereby 5-70% by volume of the hard particles having a Young's modulus of not less than 24,000 kgf/mm$^2$ are included into the carbon steel or alloying steel to form a high Young's modulus material.

In this case, when the Young's modulus of the hard particle is less than 24,000 kgf/mm$^2$, the Young's modulus of the resulting high Young's modulus material can not be rendered into not less than 22,000 kgf/mm$^2$, preferably not less than 23,000 kgf/mm$^2$. Therefore, the hard particles having a Young's modulus of not less than 24,000 kgf/mm$^2$ should be used.

When the amount of the hard particles is less than 5% by volume, the Young's modulus of not less than 22,000 kgf /mm2, preferably not less than 23,000 kgf /mm$^2$ can not be obtained and hence the resulting material can not be worked in a high precision by a tool for cold working or the weight reduction as a material for the structural member can not be attained. While, when the amount of the hard particle exceeds 70% by volume, the heat treating effect against the carbon steel or alloying steel can not be obtained, and consequently when the resulting material is subjected to an annealing, the hardness lowers, and the cutting and grinding can not be conducted and also it is impossible to improve the strength and toughness by quenching and tempering the material. Therefore, the amount of hard particles included should be within a range of 5-70% by volume.

Thus, the drawbacks of binder portion in the conventional super-hard material can be compensated by using the heat treatable carbon steel or alloying steel as a matrix for the hard particle.

The invention further provides a tool member provided at its surface with a coating layer having a Young's modulus of not less than 24,000 kgf/mm$^2$ in which 5-70% by volume of hard particles having a Young's modulus of not less than 24,000 kgf/mm$^2$ are included in carbon steel or alloying steel.

In the surface-coated tool provided with a coating layer of TiN, TiC or the like, it is considered to adequate the thickness of the coating layer, the roughness of the surface of the substrate before the coating and the like as a countermeasure for the prevention of peeling and cracking of the coating layer. In the invention, the Young's modulus of the substrate is noticed and it is attempted to solve the above problem by increasing the Young's modulus of the substrate.

Heretofore, the occurrence of peeling or cracking in the hard coating layer is due to the fact that the substrate is largely deformed in the working and the Young's modulus between the substrate and the coating layer largely differs. Therefore, according to the invention, the Young's modulus of the substrate is increased by dispersing and including a given amount of hard particles having a Young's modulus equal to or higher than that of the coating layer into the substrate.

In the invention, it has been confirmed that the hard particles are dispersed into the carbon steel or alloying steel as a matrix to increase the Young's modulus of the substrate and as the amount of the hard particle increases, the higher the Young's modulus of the substrate in the field of tool members using the carbon steel or alloying steel as a matrix. Furthermore, it has been confirmed that the deformation of the substrate can be controlled by increasing the Young's modulus of the substrate, whereby the peeling and cracking of the coating layer due to the deformation of the substrate is suppressed to improve the service life of the tool member.

In the invention, the reason why the Young's modulus of the coating layer is limited to not less than 24,000 kgf/mm$^2$ is due to the fact that the above problems are apt to be caused in the tool member having the coating layer of high Young's modulus.

According to the invention, the substrate of the tool member may be a molten material or may be provided by sintering powder of carbon steel or alloying steel.

In the former case, it is difficult to include a high amount of hard particles owing to the restriction in the production, but the later case has an advantage that the hard particles can easily be included into the substrate in a high ratio.

Furthermore, the powder previously containing the hard particles may be sintered to form a substrate for tool members in the invention.

The surface-coated tool member comprising the above substrate and a coating layer having a Young's modulus of not less than 24,000 kfg/mm$^2$ is good in the durability, less in the seizure or baking during the working, excellent in the abrasion resistance and easy in the working with a high precision, so that it is particularly suitable as a cold working tool and cutting tool used under severe conditions.

In the high Young's modulus material according to the invention, 5-70% by volume of hard particles having a Young's modulus of not less than 24,000 kgf/mm$^2$ are included into carbon steel or alloying steel, so that the Young's modulus of the resulting material is higher than of the conventional iron steel material. For example, therefore, the working accuracy is enhanced in the cold working, or the hardness, strength and toughness can be changed by subjecting to the heat treatment. That is, the hardness is lowered by subjecting to a heat treatment such as annealing in the cutting, whereby a cutting tool can be used. Moreover, the abrasion resistance, toughness and the like are improved in the cold working under sever use conditions, or the rigidity in the structural member is improved to reduce the weight of the member.

And also, when the above high Young's modulus material is used as a substrate of the surface-coated tool member, the deformation of the substrate is suppressed in the working, so that the peeling and cracking of the coating layer due to the deformation of the substrate is controlled to improved the service life of the tool member.

EXAMPLE

The following examples are given in illustration of the invention and are not intended as limitations thereof.

EXAMPLE 1

In this example, alloying steels having chemical compositions A to G shown in Table 1 were used to prepare materials of acceptable and comparative examples shown in No.1–7 of Table 2, whose properties were then evaluated, while the properties of super-hard materials shown in No.8–10 of Table 2 were also evaluated as a comparative example.

Among them, the material No.1 of Table 2 was a steel kind A of the conventional steel material for machine structure and molten material of chromium steel containing no hard particle.

Furthermore, the materials No.2 and 3 were shaped by dispersing at least two kinds of hard particles selected from TiN, TiC, WC, TaC and $MO_2C$ into a molten metal being steel kinds B, C of Table 1 at a volume ratio shown in Table 2.

The materials No.4, 5 were shaped by mixing powders of high-speed tool steel being steel kinds D, E and containing hard particles at a volume ratio shown in Table 2 with a small amount of sintering agent and shaping and sintering them.

The materials No.6, 7 were shaped by mixing the hard particles and powder of high-speed tool steel being steel kinds F, G of Table 1 at a volume ratio shown in Table 2, filling them in a can, subjecting to hot isostatic pressing (HIP) and then forging.

TABLE 1

| Kind of steel | Chemical composition (% by weight) | | | | | | | | | |
|---|---|---|---|---|---|---|---|---|---|---|
| | C | Si | Mn | Cr | Mo | W | V | Co | Ti | N |
| A | 0.21 | 0.19 | 0.71 | 1.01 | — | — | — | — | — | — |
| B | 0.38 | 1.05 | 0.32 | 4.95 | 1.23 | — | 1.01 | — | — | — |
| C | 0.86 | 0.21 | 0.32 | 4.05 | 5.01 | 6.02 | 1.95 | — | — | — |
| D | 1.31 | 0.31 | 0.38 | 4.15 | 4.98 | 6.39 | 3.06 | 8.04 | — | — |
| E | 2.11 | 0.29 | 0.36 | 4.22 | 6.16 | 18.30 | 5.01 | 10.18 | — | — |
| F | 2.01 | 0.24 | 0.38 | 3.00 | 3.54 | 22.08 | 2.18 | 11.03 | 4.80 | 1.42 |
| G | 3.07 | 0.17 | 0.22 | 2.27 | 2.84 | 34.51 | 1.70 | 8.32 | 4.40 | 1.30 |

TABLE 2

| No | Class | Kind of Steel | Hardness ($H_RC$) | Amount of Hard Particles (Volume %) | Density ($g/cm^3$) | Young's Modulus ($kgf/mm^2$) | Specific Elasticity (mm) |
|---|---|---|---|---|---|---|---|
| 1 | Molten Steel for Structure | A | 35 | 0 | 7.80 | 21000 | $26.9 \times 10^8$ |
| 2 | Molten Steel for Hot Die | B | 47 | 3.5 | 7.75 | 20500 | $26.4 \times 10^8$ |
| 3 | Molten Steel for High-Speed Tool | C | 64 | 18.0 | 8.16 | 22300 | $27.3 \times 10^8$ |
| 4 | Powdery Steel for High-Speed Tool | D | 64 | 14.5 | 8.03 | 22500 | $28.1 \times 10^8$ |
| 5 | Powdery Steel for High-Speed Tool | E | 71 | 44.7 | 8.56 | 24900 | $29.1 \times 10^8$ |
| 6 | Particle-dispersed Powdery Steel for High-Speed Tool | F | 72 | 40.0 | 8.50 | 26650 | $31.3 \times 10^8$ |
| 7 | Particle-dispersed Powdery Steel for High-Speed Tool | G | 73 | 55.0 | 9.41 | 30100 | $32.0 \times 10^8$ |
| 8 | Super-Hard Material | WC-10Co | 74 | 90.0 | 14.40 | 58400 | $40.5 \times 10^8$ |
| 9 | Super-Hard Material | WC-25Co | 70 | 75.0 | 12.90 | 46700 | $36.2 \times 10^8$ |
| 10 | Super-Hard Material | WC-40Co | 64 | 60.0 | 11.50 | 37500 | $32.6 \times 10^8$ |

TABLE 3

| No. | Strength at Break ($kgf/mm^2$) | Working Hardness (Annealed Hardness) ($H_RC$) | Workability (Cutting) | Hardness of Portion Containing No Hard Particle (Hv) | Remarks |
|---|---|---|---|---|---|
| 1 | 490 | 5.4 | ∘ | 350 | Comparative |

TABLE 3-continued

| No. | Strength at Break (kgf/mm$^2$) | Working Hardness (Annealed Hardness) ($H_RC$) | Workability (Cutting) | Hardness of Portion Containing No Hard Particle (Hv) | Remarks |
|---|---|---|---|---|---|
| | | | | | Example |
| 2 | 450 | 12.0 | ∘ | 470 | Comparative Example |
| 3 | 400 | 18.0 | ∘ | 750 | Acceptable Example |
| 4 | 450 | 22.0 | ∘ | 760 | Acceptable Example |
| 5 | 230 | 45.5 | ∘ | 770 | Acceptable Example |
| 6 | 250 | 43.6 | ∘ | 790 | Acceptable Example |
| 7 | 210 | 54.0 | ∘ | 780 | Acceptable Example |
| 8 | 175 | 74.1 | x | 280 | Comparative Example |
| 9 | 220 | 69.8 | x | 290 | Comparative Example |
| 10 | 270 | 63.7 | x | 275 | Comparative Example |

The density, Young's modulus and specific elasticity of the materials No.1–10 are shown in Table 2. In the materials No.1, 2 containing no hard particle or a slight amount of hard particles, the Young's modulus is low, while in the materials No.3–7 having not less than 5% by volume of hard particles, the Young's modulus is not less than 22,000 kgf/mm$^2$.

Further, in the materials No.3–7 according to the invention, the hardness after the heat treatment is high and the abrasion resistance is excellent in case of using as a tool, and also the toughness is excellent because the strength at break shows a good value as shown in Table 3.

In the materials No.1,2 as a comparative example and the materials No.3–7 according to the invention, the hardness can largely be lowered by annealing, so that these materials can be worked into a working tool by cutting, while in the super-hard materials No.8–10, the hardness is hardly lowered by annealing and hence it is difficult to conduct the cutting.

In the high Young's modulus materials according to the invention, 5–70% by volume of hard particles having a Young's modulus of not less than 24,000 kgf/mm$^2$ are included into carbon steel or alloying steel, so that the Young's modulus is high as compared with the general iron steel material and excellent in the toughness as compared with the super-hard material and it is possible to conduct the cutting and grinding by softening the matrix when the material is worked into a tool. Further, the material according to the invention is large in the Young's modulus as compared with steel for machine structure, so that when the rigidity is same, the thickness and the like of the tool member can be reduced to realize weight reduction.

EXAMPLE 2

A substrate having a chemical composition shown in Table 4 and containing hard particles at a ratio shown in Table 5 was surface-treated to form a coating layer of TiN thereon, from which was manufactured a cold forged punch. The service life of the cold forged punch when using for compressive working a head portion of a bolt is shown together with the properties of the substrate in Table 5.

TABLE 4

| Kind of Steel No. | | Chemical Composition (% by weight) | | | | | | | | | | Remarks |
|---|---|---|---|---|---|---|---|---|---|---|---|---|
| | | C | Si | Mn | Cr | Mo | W | V | Co | | | |
| 11 | Comparative | 0.26 | 0.30 | 0.66 | 1.21 | — | — | — | — | | | Molten |
| 12 | Example | 0.95 | 0.52 | 1.02 | 0.85 | — | 0.71 | 1.10 | — | | | Material |
| 13 | | 0.86 | 0.33 | 0.41 | 4.02 | 4.88 | 3.10 | 1.99 | — | | | |
| 14 | Acceptable | 2.09 | 0.33 | 0.61 | 3.99 | 6.01 | 14.08 | 5.44 | 11.94 | 4.76 Ti | 1.55 N | Powder |
| 15 | Example | 2.33 | 0.28 | 0.39 | 3.00 | 3.77 | 24.56 | 2.88 | 11.04 | 4.56 Ti | 1.55 N | Sintering |
| 16 | | 3.09 | 0.77 | 0.30 | 2.29 | 3.10 | 33.81 | 1.79 | 8.33 | | | |
| 17 | | 2.23 | 0.40 | 0.21 | 4.55 | 6.55 | 19.09 | 5.88 | 10.13 | | | |
| 18 | Comparative | | | | | *90WC-10Co | | | | | | Powder |
| 19 | Example | | | | | *75WC-25Co | | | | | | Sintering |
| 20 | Acceptable Example | 1.9 | 0.31 | 0.41 | 4.3 | 6.5 | 14.0 | 3.5 | 12.0 | | | Molten Material |
| Remarks | | | | | | *Volume % | | | | | | |

TABLE 5

| Substrate | | Coating Treatment | Hardness of Substrate ($H_RC$) | Amount of Hard Particle (Volume %) | Kind of Hard Particle |
|---|---|---|---|---|---|
| 11 | Comparative | TiN | 38 | 1 | $M_3C$ |
| 12 | Example | TiN | 59 | 3 | $M_3C$, $M_{23}C_6$ |
| 13 | | TiN | 63.9 | 12 | $M_6C$, MC |
| 14 | Acceptable | TiN | 67.0 | 27 | $M_6C$, WC |
| 15 | Example | TiN | 68.9 | 40 | TiN, $M_6C$, WC |

TABLE 5-continued

| | | | | | |
|---|---|---|---|---|---|
| 16 | | TiN | 71.2 | 55 | TiN, $M_6C$, WC |
| 17 | | TiN | 70.8 | 44 | VC, $M_6C$, WC |
| 18 | Comparative | TiN | 74 | 90 | WC |
| 19 | Example | TiN | 70 | 75 | WC |
| 13 | | None | 66.0 | 12 | $M_6C$, MC |
| 20 | Acceptable Example | TiN | 68.0 | 25 | $M_6C$, MC |

| Substrate | Young's Modulus of Hard Particle (kgf/mm²) | Young's* Modulus of Substrate (kgf/mm²) | Strength at Break (kgf/mm²) | Working Hardness ($H_RC$) | Service Life of Cold Forged Punch (Shot) |
|---|---|---|---|---|---|
| 11 | 27000 | 21000 | 405 | 6.7 | 15 |
| 12 | 28000 | 20700 | 390 | 12.0 | 1500 |
| 13 | 23800 | 22100 | 400 | 19.0 | 22000 |
| 14 | 39800 | 24600 | 305 | 29.9 | 52000 |
| 15 | 45600 | 26640 | 240 | 42.8 | 60000 |
| 16 | 44600 | 30100 | 229 | 49.9 | 76000 |
| 17 | 32600 | 24900 | 230 | 46.0 | 56000 |
| 18 | 60000 | 57900 | 172 | 73.9 | 79000 |
| 19 | 60000 | 45800 | 220 | 68.8 | 69000 |
| 13 | 23800 | 22100 | 390 | 19.0 | 13000 |
| 20 | 29000 | 24000 | 270 | 22.0 | 31000 |
| Remarks | | *Substrate: Containing Hard Particles | | | |

In the substrates No.11, 12, the amount of hard particle is less than 5% by volume, while the substrates No.18, 19 use a sintered body of WC powder (super-hard tool), respectively.

As seen from the results of Table 5, the service life of the tool member is largely improved when the substrate of the tool member contains 5–70% by volume of hard particles having a Young's modulus of not less than 24,000 kgf/mm².

In the super-hard tools No.18, 19, the service life is naturally good, but it is difficult to conduct usual plastic working, cutting and the like because the working hardness is not less than 50.

What is claimed is:

1. A high Young's modulus material containing 15.4–70% by volume of hard particles in a carbon steel or alloy steel, said hard particles having a Young's modulus of not less than 24,000 kgf/mm².

2. A high Young's modulus material according to claim 1, wherein said carbon steel or alloy steel is comprised of a steel cast from melt.

3. A high Young's modulus material according to claim 1, wherein said carbon steel or alloy steel is comprised of a sintered steel formed from powder.

4. A high Young's modulus material according to claim 1, wherein said material is comprised of a sintered body formed from powder containing hard particles with a Young's modulus of not less than 24,000 kfg/mm² in the carbon steel or alloy steel.

5. A high Young's modulus material according to claim 1, 2, 3 or 4, wherein said hard particles comprise at least two kinds of compounds selected from carbides, nitrides, borides, silicides, sulfides and oxides.

6. A high Young's modulus material according to claim 1, 2, 3, or 4, wherein said material has a specific elasticity of not less than 28.33 $10^8$ represented by Young's modulus/density.

7. A high Young's modulus material according to claim 1, 2, 3, or 4, wherein said resulting material has a Young's modulus of not less than 22,000 kfg/mm².

8. A surface-coated tool member formed by coating on a substrate a hard coating layer having a Young's modulus of not less than 24,000 kfg/mm², wherein said substrate contains 14.5–70% by volume of hard particles, said particles having a Young's modulus of not less than 24,000 kfg/mm², in a carbon steel or alloy steel matrix.

9. A surface-coated tool member according to claim 8, wherein said carbon steel or alloy steel of the substrate is comprised of a steel cast from melt.

10. A surface-coated tool member according to claim 8, wherein said substrate is composed of a sintered body formed from powder.

11. A surface-coated tool member according to claim 8, wherein said substrate is composed of a sintered body formed from powder containing hard particles having a Young's modulus of not less than 24,000 kfg/mm² in carbon steel or alloy steel.

12. A surface-coated tool member according to claim 8, 9, 10 or 11, wherein said hard particles comprise at least two kinds of compounds selected from carbides, nitrides, borides, silicides, sulfides, and oxides.

13. A surface-coated tool member according to claim 8, 9, 10, 11, wherein said substrate has a Young's modulus of not less than 22,000 kgf/mm².

* * * * *

UNITED STATES PATENT AND TRADEMARK OFFICE

CERTIFICATE OF CORRECTION

PATENT NO. : 5,306,568

DATED : April 26, 1994

INVENTOR(S) : Yukinori MATSUDA et al.

It is certified that error appears in the above-identified patent and that said Letters Patent is hereby corrected as shown below:

At column 10, line 3 of claim 6, delete "28.33 $10^8$" and insert --28 x $10^8$mm--.

Signed and Sealed this

Second Day of August, 1994

Attest:

Bruce Lehman

BRUCE LEHMAN

Attesting Officer

Commissioner of Patents and Trademarks